United States Patent [19]

Falstrup

[11] Patent Number: 4,646,984

[45] Date of Patent: Mar. 3, 1987

[54] RETRACTING TENSIONING MECHANISM FOR DISPENSING AN ELONGATED MEMBER

[75] Inventor: David C. Falstrup, Manhattan Beach, Calif.

[73] Assignee: Hitco, Newport Beach, Calif.

[21] Appl. No.: 628,503

[22] Filed: Jul. 6, 1984

[51] Int. Cl.[4] ..... B65H 75/00

[52] U.S. Cl. ..... 242/54 R; 242/75.3; 242/75.4; 242/84.51 R; 242/129.3; 242/129.8; 242/156.2; 188/82.7; 188/82.77

[58] Field of Search ..... 242/54, 75.3, 75.4, 242/129.3, 129.8, 156, 156.2, 84.51 R; 188/82.7, 82.77

[56] References Cited

U.S. PATENT DOCUMENTS

| | | | |
|---|---|---|---|
| B 506,167 | 2/1976 | Brown | 242/129.8 |
| 1,135,702 | 4/1915 | Larson | 242/156 |
| 1,636,158 | 7/1927 | Tynan | 242/156.2 |
| 3,243,137 | 3/1966 | Norman | 242/156.2 X |
| 3,314,623 | 4/1967 | Blandino | 242/129.3 X |
| 3,632,062 | 1/1972 | Sole | 242/147 R |
| 3,648,948 | 3/1972 | Level | 242/156 |
| 3,990,652 | 11/1976 | Brown | 242/129.8 |

FOREIGN PATENT DOCUMENTS

| | | | |
|---|---|---|---|
| 436752 | 8/1972 | U.S.S.R. | 242/75.4 |

*Primary Examiner*—Donald P. Walsh

*Attorney, Agent, or Firm*—Bogucki, Scherlacher, Mok & Roth

[57] ABSTRACT

A retracting tensioning mechanism for dispensing an elongated member such as a length of yarn wound on a carrier tube in a creel utilizes a rotatably mounted disk coupled to the carrier tube and having a plurality of outwardly extending, spaced-apart elements in the form of pegs disposed in a circular array about the outer periphery thereof. An elongated lever which is at least partly disposed within the circular array of pegs is rotatably mounted about a pivot axis offset from and generally parallel to the axis of rotation of the disk and the carrier tube and has an elongated tongue extending outwardly from the pivot axis and into contact with the pegs. A force-biasing arrangement which can comprise a suspended weight, a tension spring or a torsion spring biases the elongated lever about the pivot axis so as to tend to rotate the elongated tongue and the peg which the tongue engages in a direction tending to wind the yarn on the carrier tube, causing the yarn to retract under tension when the yarn is relatively slack. When the yarn is being pulled so as to unwind it from the carrier tube, the elongated tongue of the lever rotates with and then bears against the pegs as necessary so as to maintain a desired amount of tension in the yarn as the yarn is unwound from the carrier tube.

17 Claims, 11 Drawing Figures

RETRACTING TENSIONING MECHANISM FOR DISPENSING AN ELONGATED MEMBER

BACKGROUND OF THE INVENTION

1. Field of the Invention

The present invention relates to a retracting tensioning mechanism for dispensing an elongated member, and more particularly to arrangements for supplying lengths of yarn from creels to a loom for purposes of weaving a fabric.

2. History of the Prior Art

Certain mechanisms and processes sometimes require that an elongated member be unwound from a carrier tube, bobbin or similar device under tension. It may be desirable or necessary in such operations that the tension on the elongated member be maintained relatively constant or at least within a relatively small range of values in the face of widely varying amounts of force exerted on the elongated member as it is unwound from the carrier tube. It may furthermore by desirable or necessary that the elongated member be retracted to some extent when the force thereon is sufficiently low and the elongated member becomes slack.

Examples of such arrangements and processes are found in the field of weaving. Certain types of weaving require relatively close control of tension on the yarns being fed into a loom so that a desired density, uniformity, precise alignment and other characteristics of the woven fabric can be achieved. This is particularly true in the case of woven fabrics used in the aerospace industry were requirements are usually far greater than in the general textile industry. Because of tension variations including periods of actual slack created by the movement of the harnesses in the loom to which the various warp yarns are fed, various different arrangements and techniques have been employed for supplying a plurality of warp yarns to the loom in a manner which attempts to minimize tension variations in the yarns. One such technique is used in conjunction with winding the individual dual yarns on a large drum or beam such that the individual yarns are wound side-by-side and under controlled tension. In weaving, the yarns feeding into the loom from the beam pass over whip rolls which serve to take up yarn slack and to maintain yarn tension during the shedding action of the loom harnesses. This has proven to be a relativley satisfactory technique in the case of nonfragile yarns such as those made of cotton, wool and synthetics such as nylon, rayon and the like. Such yarns are comprised of individual filaments which are twisted together before the yarn is wound on the drum or beam. Such yarns are relatively durable and are resistant to abrasion during handling and during the process in which the yarns are fed into the loom. The process of winding the yarns onto the drum or beam arrangement and thereafter dispensing the yarns in such a way that the yarns are required to undergo sharp bends therein and over relatively rough and abrasive surfaces does not pose a particular problem with twisted yarns of relatively durable composition.

A different set of considerations exist however where the fabric is being woven from relatively frgaile yarns such as those of graphite, ceramic or quartz composition. Such yarns may consist of a bundle of very fine filaments combined into a ribbon having little or no twist. The individual filaments have very little resistance to bending around a short radius and little resistance to abrasion. As sharp bends and abrasions occur, the individual filaments break and become trapped under adjoining ends, making it difficult to deliver the yarns into the loom and to weave a uniform fabric. The broken filaments tend to tangle, for example, making it difficult and in some cases impossible to feed the yarns through eyelets or other confined areas as the yarns are delivered to the loom.

Because of these problems, yarns of graphite or similar fragile composition are normally supplied to the loom using warp creels. Such arrangements dispose a plurality of yarn carrier tubes in rotatable, side-by-side relation so that the individual lengths of yarn wound on each carrier tube can be unwound from the tubes simultaneously for delivery into the loom. A friction-type element may be employed to bear against the carrier tubes or yarns to provide tension in the yarns. Alternatively, hairpin-shaped weights may be hung over the individual yarns in the regions where they are unwound from the carrier tube to apply tension to the yarns. As the warp harnesses in the loom are raised and lowered so as to create a condition of varying tension on the yarns, the hairpin-shaped weights have the effect of taking up some of the slack so as to reduce the effects of the tension variations. Nevertheless, even where the weights are used, the tension variations and inconsistencies are still too great in many instances for the satisfactory weaving of a precise, uniform fabric. In addition, the weights themselves involve additional bending and abrasion of the delicate yarns resulting in filament breakage, twisting and gathering.

Consequently, it is desirable in certain applications to utilize a tensioning arrangement which does not utilize suspended weights or similar devices having the attendant disadvantages noted above. Examples of arrangements for tensioning yarn or wire filaments are provided by U.S. Pat. Nos. 3,307,805 of Verbeek and B506,167 of Brown. Still other examples of tensioning devices using a type of rachet mechanism are provided by U.S. Pat. Nos. 3,314,623 of Blandino and 1,050,047 of Walkup. Still further examples of such arrangements are provided by U.S. Pat. Nos. 1,730,431 of Keefer and 1,914,014 of Gobeille. While such arrangements can function to provide some tension during the unwinding of an elongated web member, they tend to suffer from a number of shortcomings. Aside from mechanical complexity in some instances, such arrangements do not provide retraction of the web member under slack conditions while minimizing yarn damage in a simple and cost effective way. Moreover, the weaving of certain fabrics requires retraction of part or all of the warp during weaving.

Thus, while some variation of tension in the warp yarns is permissible in weaving operations of this type, it is important that a slack condition be prevented. Relatively constant tension under all conditions is nevertheless desirable, particularly if it can be accomplished without damgaging the fragile yarns. Accordingly, it is an object of the invention to provide an improved arrangement for maintaining tension in an elongated member.

If is a further object of the invention to provide an arrangement for maintaining in an elongated member tension which is relatively constant or at least within an acceptable range of values in the face of substantially widely varying amounts of force on the elongated member as it is being unwound from a carrier tube, bobbin or similar device.

It is a still further object of the invention to provide an arrangement for tensioning an elongated member, which arrangement is capable of retracting the elongated member during conditions of slack in the elongated member.

BRIEF DESCRIPTION OF THE INVENTION

These and other objects are accomplished in accordance with the invention by a retracting tensioning mechanism of relatively simple design. The retracting tensioning mechanism is capable of maintaining relatively constant tension on an unreeling elongated member such as a length of yarn in the face of widely varying force on the yarn. Moreover, such tensioning mechanism retracts as necessary in the face of very low tension or slack on the elongated member or yarn so as to provide some retraction of the elongated member or the yarn while maintaining a desired amount of tension thereon.

In a perferred arrangement of a retracting tensioning mechanism in accordance with the invention a rotatably mounted member is coupled to a carrier tube, bobbin or similar device having an elongated member wound thereon. The rotatably mounted member has a plurality of elements mounted thereon in a spaced apart, generally circular array, and an elongated lever which is pivotally mounted about a pivot axis and which has an outer end adapted to engage the plurality of elements mounted on the rotatable element. The lever is force-biased in a given direction about the pivot axis. As so biased, the lever engages the spaced-apart elements mounted on the rotatable member so as to tend to rotate the rotatable member and the attached carrier tube or bobbin in a direction to prevent the unwinding of the elongated member therefrom and thereby maintain desired tension on the elongated member. As the unwinding force is applied to the elongated member, the lever rotates about the pivot axis in a direction opposite the direction of the applied force so as to allow the rotatably mounted member and the attached carrier tube or bobbin to rotate in a direction which unwinds the elongated member therefrom while at the same time maintaining the desired tension on the elongated member. If the unwinding force on the elongated member is essentially removed, the lever rotates in response to the biaisng so as to eventually retract the elongated member by an amount sufficient to continue to maintain a desired tension in the elongated member.

In one embodiment of a retracting tensioning mechanism in accordance with the invention, the rotatably mounted member comprises a circular disk and the elements mounted thereon comprise generally cylindrical pegs mounted in spaced-apart relation about the periphery of the circular disk. The lever is at least partially mounted within the array of pegs and has an elongated tongue which extends outwardly from the pivot axis and into engagement with the pegs. The force-bias is applied to the lever by any of several different arrangements, one of which employs a weight. The weight is suspended from a bracket forming a part of the lever and disposed on the opposite side of the pivot axis from the elongated tongue. In a different biasing arrangement a coil spring has a first end thereof coupled to the bracket of the lever and an opposite second end coupled to a fixed reference point. In a still different biasing arrangement a torsion spring has one end coupled to the lever and an opposite end coupled to a fixed reference.

The carrier tube may be rotatably mounted on a creel spindle, in which even the disk is also rotatably mounted on the creel spindle. A base member fixedly mounted on the creel spindle extends outwardly therefrom so as to pivotally mount the lever thereon.

BRIEF DESCRIPTION OF THE DRAWINGS

The foregoing and other objects, features and advantages of the invention will be apparent from the following more particular description of preferred embodiments of the invention, as illustrated in the accompanying drawings, in which.

DETAILED DESCRIPTION

Figure 1:
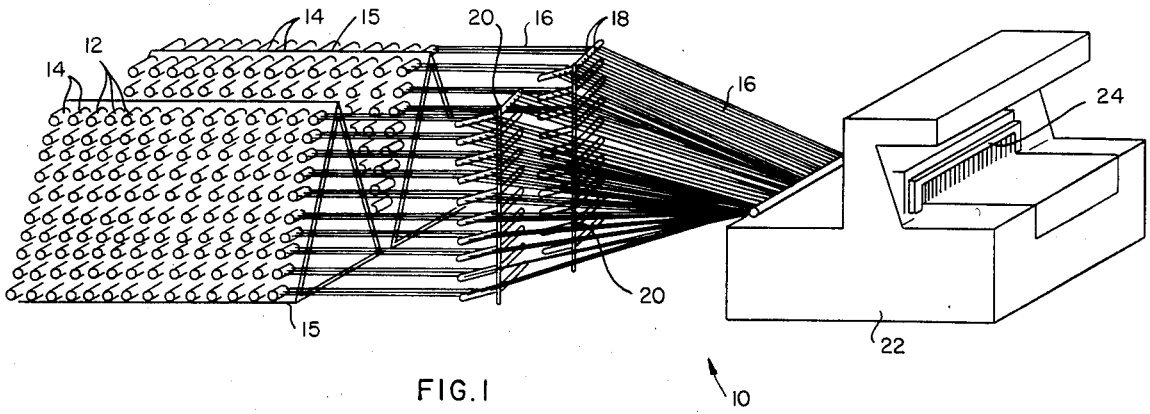
FIG. 1 is a perspective view of a weaving arrangement including a loom and a plurality of creels employing retracting tensioning mechanisms in accordance with the invention.

FIG. 1 depicts a weaving arrangment 10 utilizing a plurality of yarn holders 12 having retracting tensioning mechanisms 14 in accordance with the invention. While the retracting tensioning mechanisms 14 are hereafter described in connection with the unwinding of yarns during weaving using a loom, it should be understood that the retracting tensioning mechanisms in accordance with the invention can be utilized in other applications where desired tension is to be maintained during the unwinding of elongated members.

The yarn holders 12 form parts of two different creels 15 which feed a plurality of yarns 16 through individual eyelets 18 in a pair of guides 20. From the guides 20 the yarns 16 converge at one end of a conventional loom 22 where they are fed through a plurality of warp harnesses 24. The warp harnesses 24 move up and down under action of the loom 22 to raise and lower various ones of the yarns 16 as fill yarns are inserted therebetween using a rapier assembly or similar structure in conventional fashion.

The continuous raising and lowering of the warp harnesses 24 during the weaving process continuously varies the tension on each of the yarns 16 as the yarn 16 is gradually fed from the yarn holder 12 into the loom 22. The alternating conditions of increased tension and then slack conflict with the desire to be able to feed the yarns 16 into the loom 22 at a relatively constant tension. Such constant tension is important in the weaving of certain fabrics where factors such as density, alignment and the precision of weaving are important. It is also important to maintian the shed through relatively constant tension so as to provide an unobstructed path for the rapier assembly or other fill yarn inserting member within the loom. At the same time use of relatively fragile material such as graphite for the yarns 16 requires that the yarns 16 be fed into the loom 22 by an arrangement which minimizes abrasion and sharp bending of the yarns.

Figure 2:
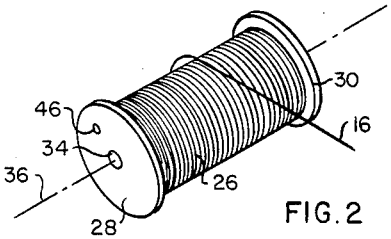
FIG. 2 is a perspective view of a yarn carrier tube from one of the creels of FIG. 1 having a length of yarn wound thereon.

FIG. 2 depicts a typical yarn carrier tube 26 having a length of the yarn 16 wound on the outer surface thereof. The tube 26 is of hollow, generally cylindrical configuration and is made of cardboard or similar material. A length of the yarn 16 is wound around the outer surface of the tube 26 between a pair of disks 28 and 30 mounted at the opposite ends of and forming a part of the yarn carrier tube 26. Careful winding of the yarn 16 and the ability to pull the yarn straight off of the tube 26 as it rotates preserve the integrity of the individual filaments making up the yarn 16 so as to prevent filament breakage and other damage to the yarn 16.

In accordance with the invention each of the yarn holders 12 in the weaving arrangement of FIG. 1 is provided with a retracting tensioning mechanism 14. The retracting tensioning mechanism 14 which is of relatively simple construction is capable of providing a desired amount of tension in an associated one of the yarns 16 being dispensed from a carrier tube 26 associated therewith in the face of widely varying force on the yarn. The force on the yarn 16 as exerted by the loom 22 ranges from a substantial value when the yarn 16 is being rapidly unwound from the carrier tube 26 to a condition of virtually no force at all during which the yarn 16 actually becomes slack. The retracting tensioning mechanism 14 is capable of maintaining a desired amount of tension in the yarn 16 as the force exerted on the yarn 16 by the loom 22 varies over a relatively wide range. During conditions when the yarn 16 would otherwise become slack, the retracting tensioning mechanism 14 retracts the yarn 16 as necessary so as to continue to maintain a desired tension in the yarn 16.

Because the retracting tensioning mechanism 14 does not contact the yarn 16, the yarn carrier tubes 26 are easily installed in and removed from the creels 15. This contrasts with the hairpin weights of the prior art, for example, where such weights must be removed and then replaced each time a yarn package consisting of a length of yarn wound on a carrier tube is replaced.

Figure 3:
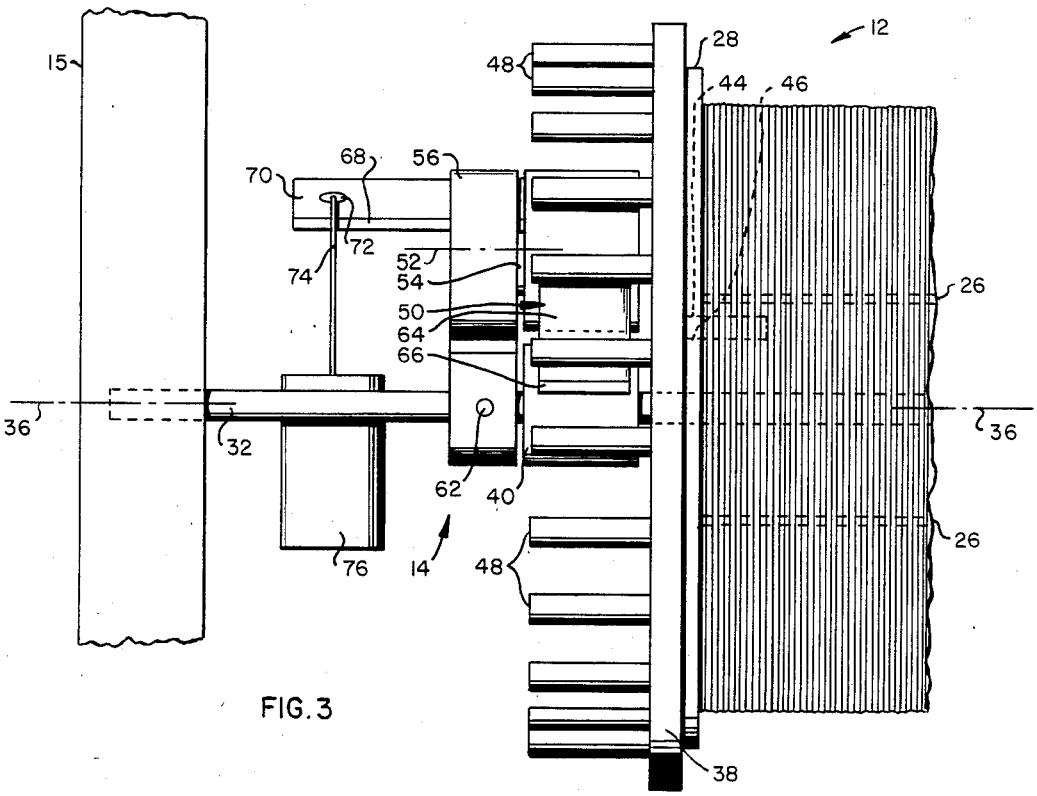
FIG. 3 is a side view of one particular embodiment of a retracting tensioning mechanism used in the arrangement of FIG. 1 in which a suspended weight is used to bias a lever therein.
Figure 4:
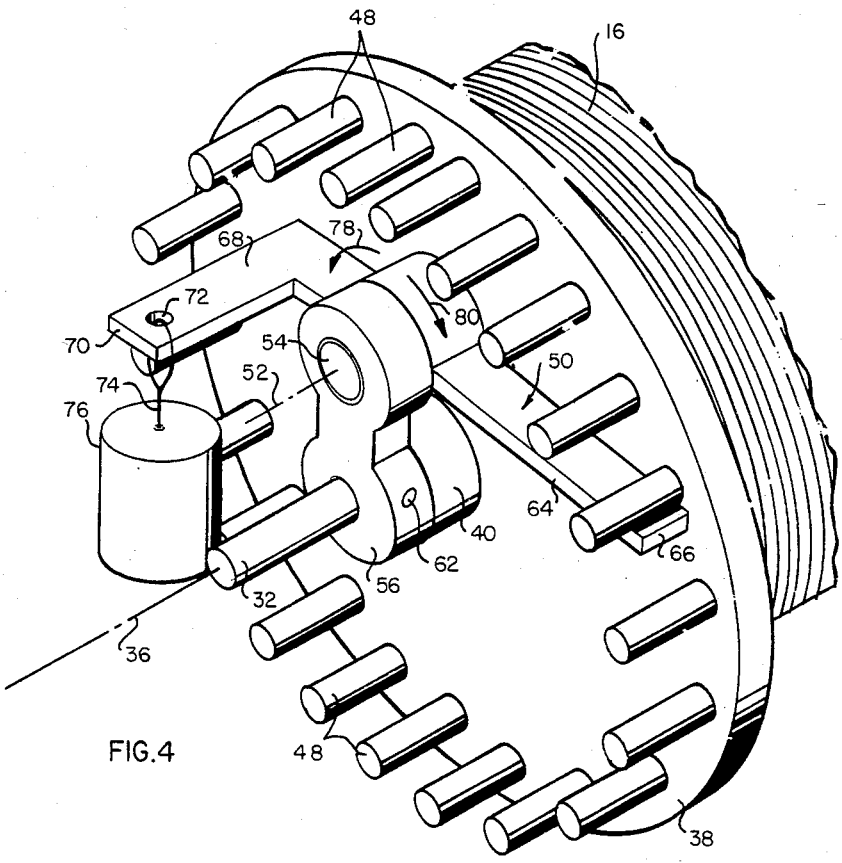
FIG. 4 is a front perspective view of the retracting tensioning mechanism of FIG. 3.
Figure 5:
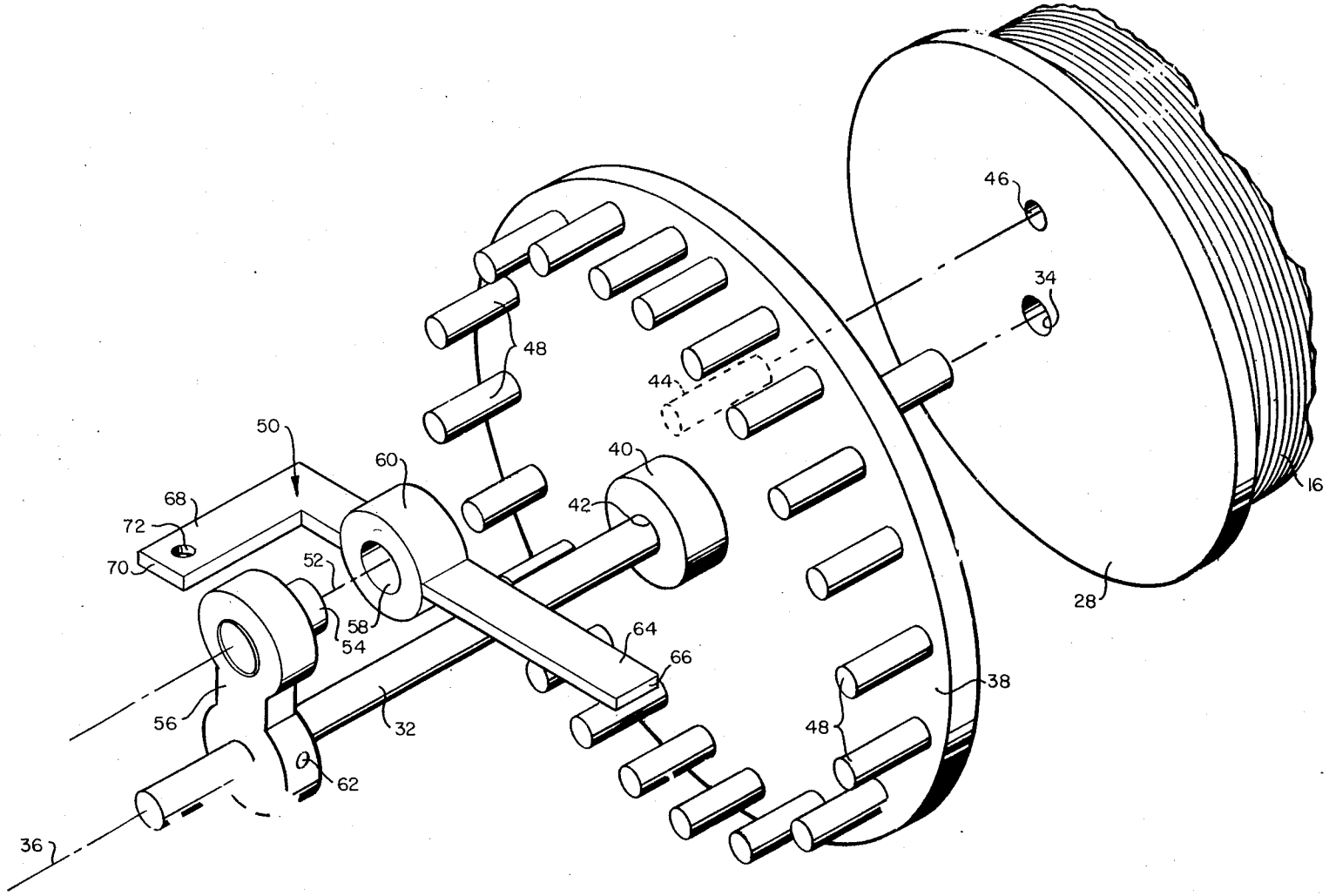
FIG. 5 is a perspective, exploded view of the retracting tensioning mechanism of FIG. 3.

One embodiment of the retracting tensioning mechanism 14 in accordance with the invention is shown in FIGS. 3–5. In FIGS. 3–5 the retracting tensioning mechanism 14 is illustrated in conjunction with an elongated, rod-like creel spindle 32 which is mounted on one of the creels 15 so as to extend outwardly therefrom. Each of the creels 15 shown in FIG. 1 has a plurality of the creel spindles 32 mounted thereon. A different creel spindle 32 is associated with each of the yarn holders 12 in the embodiment of FIGS. 3–5, although in practice two or more of the yarn holders 12 can be mounted on each creel springle 32.

As shown in FIG. 2 the yarn carrier tube 26 has a central aperture 34 therethrough extending along an axis of elongation 36 of the carrier tube 26. The yarn carrier tube 26 is mounted on one of the creels 15 by inserting one of the creel spindles 32 into and through the central aperature 34. As shown in FIG. 1 each of the creels 15 is disposed at a relatively small angle relative to the vertical with the result that the creel spindles 32 project slightly upwardly from the horizontal. This aids in retaining the yarn carrier tube 26 on the creel spindle 32 as the carrier tube 26 rotates to dispense the yarn 16 therefrom.

The retracting tensioning mechanism 14 as shown in FIG. 3–5 can be installed on existing creels 15 by mounting on the creel spindle 32 between the frame of the creel 15 and the yarn carrier tube 26. Alternatively, as discussed hereafter, the retracting tensioning mechanism 14 can be built into the creel 15 where desired so as to become an essentially permanent part of the creel 15.

The retracting tensioning mechanism 14 includes a rotatably mounted member in the form of a circular disk 38 which is coupled to the yarn carrier tube 26 for rotation therewith. The disk 38 has a hub 40 at the center thereof having an aperature 42 therethrough. The hub 40 of the disk 38 receives the creel spindle 32 within the aperature 42 to rotatably mount the disk 38.

The disk 38 is coupled to the yarn carrier tube 26 by a generally cylindrical post 44 mounted on a side of the disk 38 facing away from the creel 15. The post 44 is received within an aperture 46 in the disk 28 of the yarn carrier tube 26. Of course, other arrangements for coupling the disk 38 to the yarn carrier tube 26 can be used.

The side of the disk 38 opposite the post 44 and adjacent the creel 15 is provided with a generally circular array of spaced-apart elements in the form of pegs 48. The pegs 48 are arranged in spaced-apart fashion about the outer periphery of the disk 38 so as to form a circular array having its center at the creel spindle 32 which lies along the axis of elongation 36 of the yarn carrier tube 26.

An elongated lever 50 is at least partly mounted within the circular array of pegs 48 so as to be pivotable about a pivot axis 52 offset from and generally parallel to the axis of elongation 36 of the yarn carrier tube 26. In the retracting tensioning mechanism 14 of FIGS. 3–5, the pivot axis 52 is defined by a pivot shaft 54 extending outwardly from the side of a base member 56 and rotatably received within an aperture 58 in a cylindrical collar 60 forming a part of the lever 50. The base member 56 is mounted on the creel spindle 32 at the lower end thereof and is firmly secured in place on the creel spindle 32 such as by a set screw 62. Alternatively, the pivot shaft 54 can be mounted on the frame of the creel 15 with the base member 56 being eliminated in such instance.

The lever 50 includes an elongated tongue 64 extending outwardly from the collar 60 on one side of the pivot axis 52. The elongated tongue 64 has an outer end 66 adapted to engage the pegs 48 so as to maintain tension on the yarn 16 as described hereafter. A bracket 68 mounted on the opposite side of the collar 60 from the elongated tongue 64 forms part of an arrangement for biasing the lever 50 about the pivot axis 52 in a given direction in the particular arrangement of FIG. 3–5. In such example the bracket 68 is generally L-shaped in configuration such that a major portion thereof extends in a direction parallel to the pivot axis 52 so as to dispose an outer end 70 thereof outside of the circular array of pegs 48. The outer end 70 has an aperture 72 therein for receiving a hook 74. The hook 74 is coupled to and suspends a weight 76 below the outer end 70 of the bracket 68.

As best seen in FIG. 4 the weight 76 provides a rotational force-bias on the lever 50 about the pivot axis 52 in a direction shown by an arrow 78. At the same time force exerted on the yarn 16 by the loom 22 is in a direction tending to rotate the yarn carrier tube 26 and thereby the disk 38 in an opposite direction as illutrated by an arrow 80 in FIG. 4. The pegs 48 engage the outer end 66 of the elongated tongue 64, causing the lever 50 to tend to rotate in the direction of the arrow 80 when the disk 38 rotates in the direction of the arrow 80.

Figure 6:
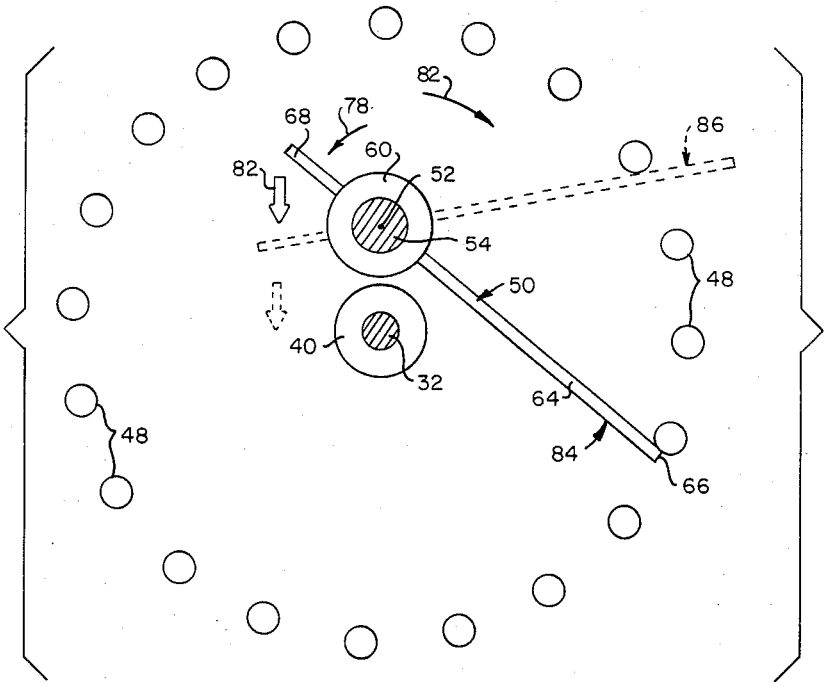
FIG. 6 is a front view of a portion of the retracting tensioning mechanism of FIG. 3 illustrating the operation of such mechanism.

The operation of the retracting tensioning mechanism 14 can be better understood with reference to FIG. 6 in which the weight 76 has been omitted for simplicity. Instead, an arrow 82 is included to show the direction of force exerted on the bracket 68 by the weight 76. During a typical weaving operation within the loom 22 the force on the yarn 16 alternates between one extreme where the yarn 16 is unwound from the yarn carrier tube 26 with substantial force to the other extreme where the force disappears and the yarn 16 actually becomes slack. At the same time it is desired that the yarn 16 be provided with a desired amount of tension in the face of such varying conditions. This is accomplished by the retracting tensioning mechanism 14 in a manner which is illustrated in FIG. 6.

When force is applied to the yarn 16 to cause the yarn carrier tube 26 and the attached disk 38 to rotate in the direction of the arrow 80, the circular arrangement of pegs 48 engages the outer end 66 of the elongated tongue 64 so as to rotate the lever 50 against the bias of the weight 76 into a position 84 shown in FIG. 6 in which the very tip of the outer end 66 of the elongated tongue 64 resides against one of the pegs 48. As the disk 38 continues to rotate in the direction of the arrow 80 as the yarn 16 is dispensed therefrom, the tip of the outer end 66 of the elongated tongue 64 skips from one to the other of the pegs 48. This action assures that a nominal amount of tension is maintained on the yarn 16.

When the unwinding force on the yarn 16 as exerted by the loom 22 decreases, the movement of the various pegs 48 across the tip of the outer end 66 of the elongated tongue 64 slows until eventually the outer end 66 of the elongated tongue 64 resides against one of the pegs 48. As the force on the yarn 16 continues to decrease, the force-bias provided by the weight 76 causes the lever 50 to rotate in the direction of the arrow 78. This causes the disk 38 and the attached yarn carrier tube 26 to rotate in a direction opposite the arrow 80 to wind the yarn 16 back onto the yarn carrier tube 26. This pulls the yarn 16 back out of the loom 22 by an extent sufficient to maintain a desired amount of tension in the yarn 16. Such a retracted position 86 of the lever 50 is illustrated in dotted outline in FIG. 6.

As the pulling force on the yarn 16 again begins to increase, the particular one of the pegs 48 engaging the elongated tongue 64 of the lever 50 causes the lever 50 to rotate in the direction of the arrow 80 as the disk 38 again begins to rotate in that direction. The elongated tongue 64 moves downwardly from the dotted outline position 86 to the position 84 as the disk 38 continues to rotate in the direction of the arrow 80. When the elongated tongue 64 reaches the position 84, it remains in this position and the outer ends 66 thereof begins to skip from one to the other of the pegs 48 as rotation of the disk 38 continues. The lever 50 remains in this position with the elongated tongue 64 skipping along the pegs 48 so long as the unwinding force on the yarn 16 exceeds the bias of the weight 76. When the unwinding force on the yarn 16 again begins to decrease below this value, rotation of the disk 38 in the direction of the arrow 80 eventually terminates, following which the elongated tongue 64 remains engaged with a single one of the pegs 48 and rotates the disk 38 and the attached yarn carrier tube 26 in the direction of the arrow 78, causing the elongated tongue 64 to move from the position 84 to the position 86 as previously described.

Skipping of the end 66 of the elongated tongue 64 over the pegs 48 causes some oscillation or variation in tension due to the changing direction of the component of the lever force. Such tension oscillations may be minimized by selection of the relative sizes, spaces and operating angles of the various parts and by varying the number and thereby the spacing of the pegs 48.

Figure 7:
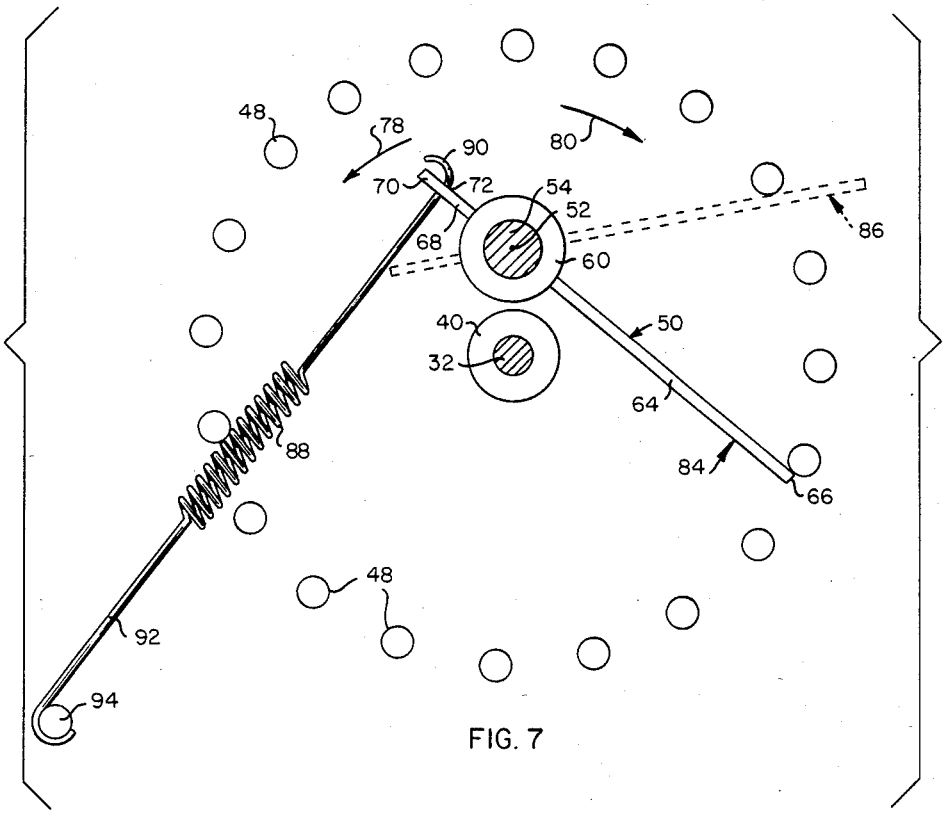
FIG. 7 is a front view of a portion of a retracting tensioning mechanism of the type used in the arrangement of FIG. 1 and utilizing a tensioning coil spring to bias the lever.

In the arrangement of FIGS. 3–5 force-biasing of the lever 50 is provided by the suspended weight 76. FIG. 7 shows an alternative arrangement for biasing the lever 50. In the arrangement of FIG. 7 the weight 76 and its included hook 74 are replaced by a tension spring 88 which is coiled at a central portion thereof and which has a first end 90 thereof hooked through the aperture 72 in the outer end 70 of the bracket 68 and an opposite second end 92 coupled to a fixed reference 94. The fixed reference 94 may comprise a separate post mounted on the creel 15 or it may comprise a different one of the creel spindles 32. As in the case of the weight 76, the tension spring 88 biases the lever 50 for rotation in the direction of the arrow 80. The tension spring 88 may provide certain advantages over the weight 76 used in the arrangement of FIGS. 3–5. By choosing different spring constants the operating characteristics can be varied so as to achieve different tension characteristics as discussed hereafter.

The particular arrangement shown in FIG. 7 attaches the second end 92 of the tension spring 88 to the fixed reference 94. This is not an essential mounting arrangement, and in some instances it may be preferable to make the second end 92 of the spring adjustable. This can be accomplished by coupling an elongated element having a plurality of apertures spaced along the length thereof to the fixed reference 94. The second end 92 of the tension spring 88 can then be located in different ones of the apertures to vary spring tension. Alternatively the angular position of the base member 56 in the creel spindle 32 can be changed, or the second end 92 of the spring 88 can be provided with a turnbuckle or can be coupled to an adjustable lever.

Figure 8:
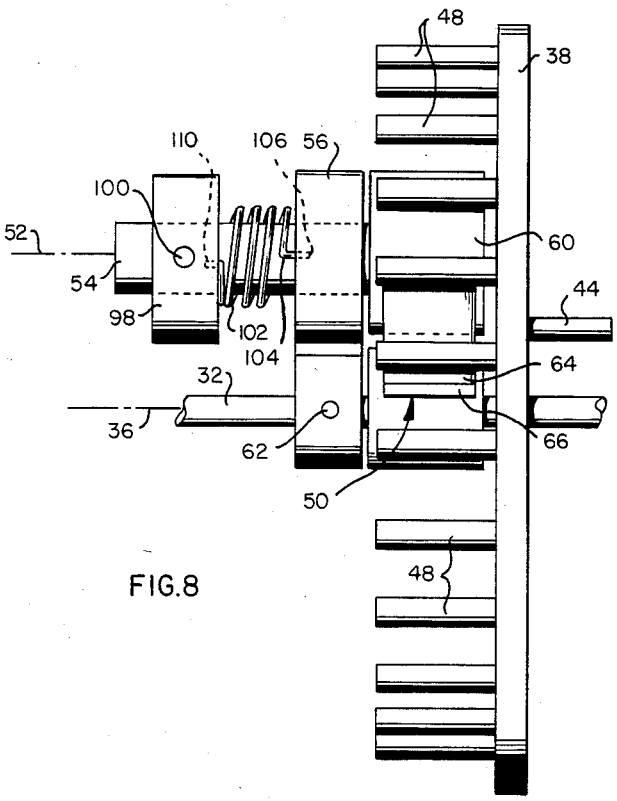
FIG. 8 is a side view of yet another arrangement of a retracting tensioning mechanism in which a torsion spring is used to bias the lever.
Figure 9:
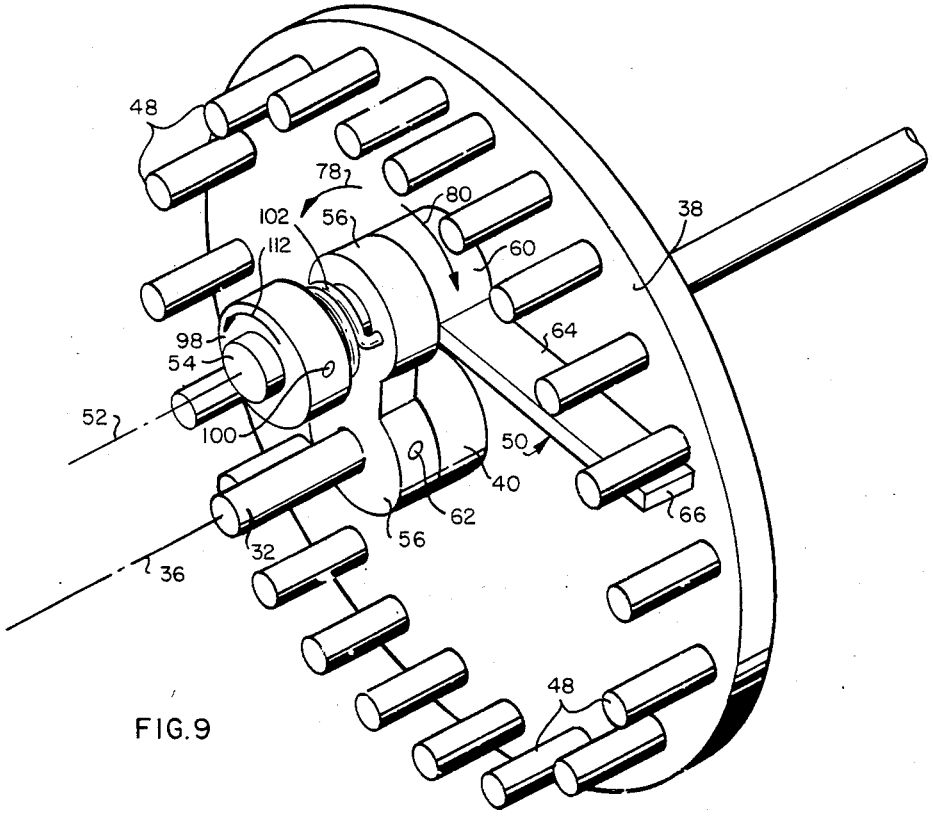
FIG. 9 is a front perspective view of the retracting tensioning mechanism of FIG. 8.
Figure 10:
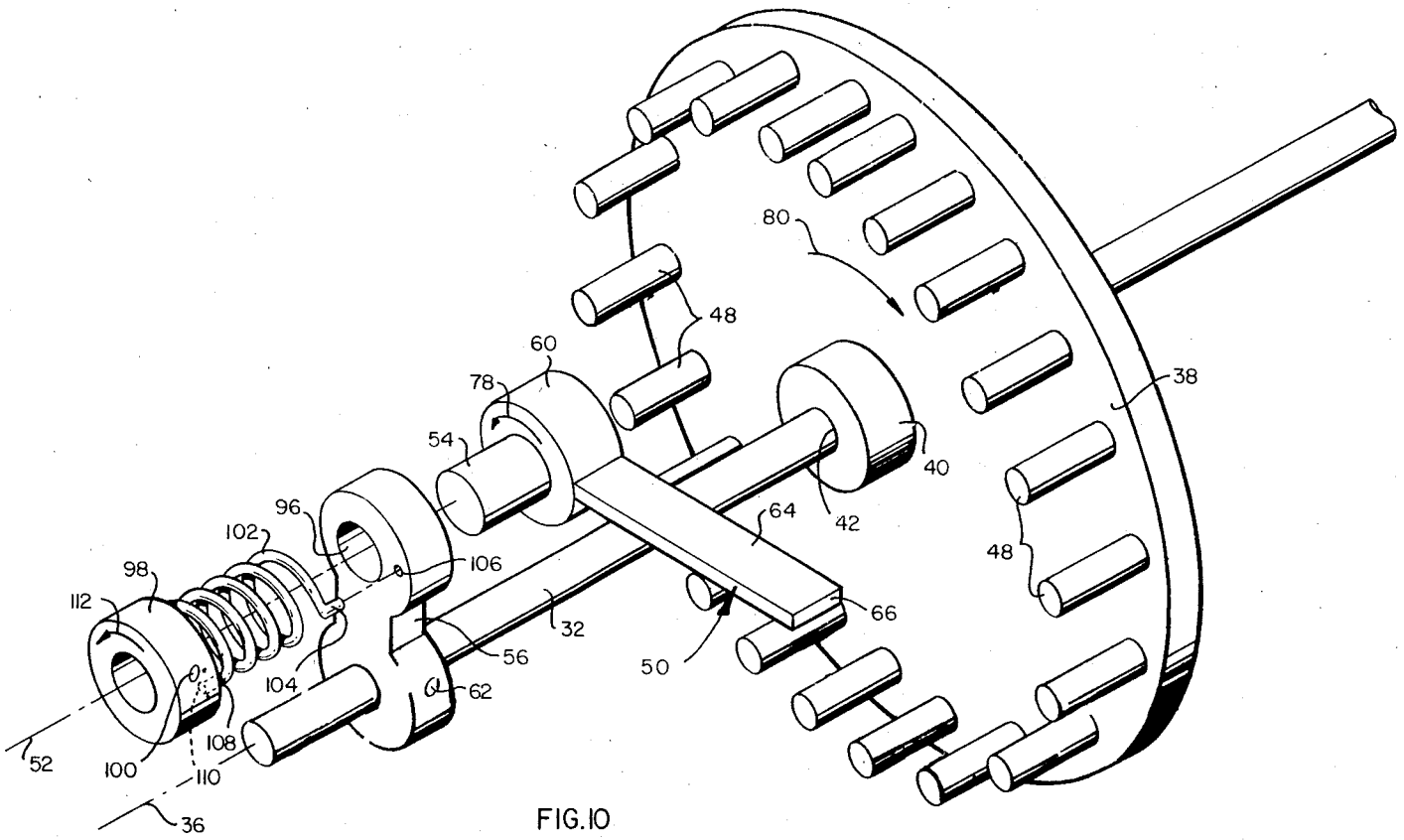
FIG. 10 is a perspective, exploded view of the retracting tensioning mechanism of FIG. 8.

FIGS. 8–10 illutrate a still further arrangement for force-biasing the lever 50. In the arrangement of FIGS. 8–10 the bracket 68 is eliminated from the lever 50. In addition the pivot shaft 54 is mounted within the collar 60 of the lever 50 and is rotatbly received within an aperture 96 at the upper end of the base member 56. The pivot shaft 54 extends through the aperture 96 and a collar 98 is fixedly mounted on the outer end of the pivot shaft 54 on the opposite side of the base member 56 from the lever 50. The collar 98 is secured against rotation on the outside of the pivot shaft 54 by a set screw 100. A torsion spring 102 of generally coiled configuration is loosely disposed about the outside of the pivot shaft 54 between the upper end of the base member 56 and the collar 98. A first end 104 of the torsion spring 102 is received in an aperture 106 in the upper end of the base member 56 adjacent the aperture 96. An opposite second end 108 of the torsion spring 102 is received within an aperture 110 in the collar 98.

The torsion spring 102 attempts to rotate the collar 98 in a direction shown by an arrow 112 relative to the base member 56 so as to rotate the lever 50 in the direction of the arrow 78. In this manner the lever 50 is biased to rotate in a direction so as to maintain the desired tension in the yarn 16 while at the same time providing retraction as necessary.

Figure 11:
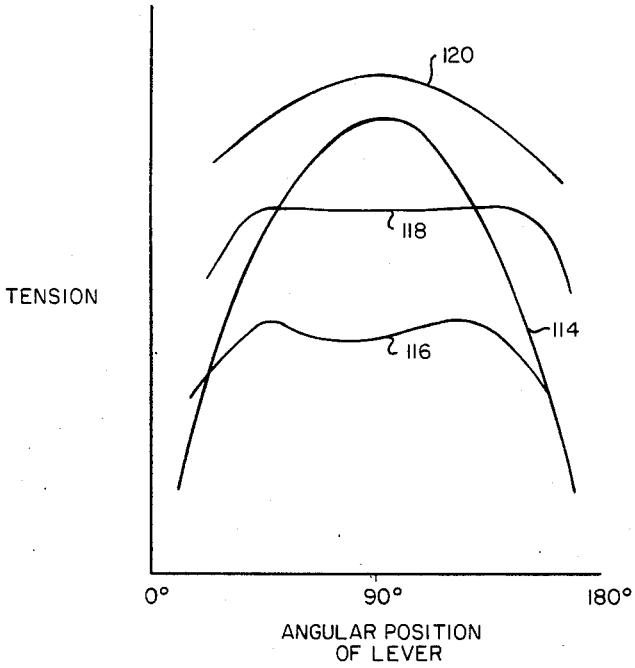
FIG. 11 is a plot of tension as a function of the angular position of the lever, illustrating the manner in which tension varies in the different arrangements for biasing the lever.

FIG. 11 represents yarn tension as a function of the angular position of the lever 50. The angular position of the lever 50 is shown as varying from 0° in which the elongated tongue 64 is extending straight upwardly to 180° where the elongated tongue 64 is extending straight downwardly.

A first curve 114 represents the case in which the suspended weight 76 is used to bias the lever 50. The curve 114 shows that in the case of the suspended weight 76, the tension varies with changing angular position of the lever 50. The tension is at a minimum near the 0° and 180° positions and at a maximum when the lever 50 is at the 90° position with the elongated tongue 64 thereof extending straight out to the right as viewed in FIG. 6. As a practical matter, and as previously described in connection with FIG. 6, the lever 50 rotates through an angular range considerably smaller than 180°. Consequently, the variation in tension is considerably less than that which is represented by the entire curve 114. Moreover, despite the variations in tension with angular position as indicated by the curve 114, such variations are still considerably less than in the case where the hairpin-shaped weights of the prior art are used to maintian the yarn in tension. Where hairpin-shaped weights are used, tension is derived from friction between the weights and the yarns, and the coefficient of friction therebetween varies due to snags and other changing surface effects. Also, the weight may become hung-up, in which event the force provided thereby is removed or reduced. The suspended weight 76 still comprises an attractive way of biasing the lever 50 because of the simplicity of the design involved.

Use of the tension spring 88 as shown in FIG. 7 to bias the lever 50 provides the capability of achieving more favorable tension characteristics for certain applications. It has been determined that by varying the spring constant, different tension characteristics can be achieved. Curves 116, 118 and 120 in FIG. 11 provide three different examples of tension characteristics which can be provided by springs having different spring constants. The curves 116, 118 and 120 all have less tension variations than in the case of the curve 114 and at the same time differ from one another.

The curve 116 achieved by use of a tension spring 88 or a torsion spring 102 having a particular spring constant and characteristic is relatively flat and therefore denotes rather small changes in tension with changing angular position of the lever 50. It will be noted that the tension actually decreases slightly as the lever 50 approaches the 90° position from the opposite sides thereof.

At the other extreme the curve 120 represents use of a spring of considerably different spring constant. The variation in tension is greater than in the case of the curve 116 and begins to approach that of the curve 114.

The curve 118 represents a desirable compromise. The curve 118 is flatter than the curves 116 and 120, representing very slight changes in tension over a wide angular range of the lever 50. Moreover, the tension range of most of the curve 118 is at or close to optimal tension conditions for a particular weaving operation. The differences between the curves 116, 118 and 120 can be caused by such things as variations in the spring constant alone, with other factors being essentially equal.

The retracting tensioning mechanisms 14 in FIGS. 3–5, FIG. 7 and FIGS. 8–10 are of the type which can be installed in existing creels 15. Such installation is accomplished simply by mounting the base member 56 on the creel spindle 32, followed by installation of the disk 38 on the creel spindle 32. It may be desirable for certain applications, however, to construct the creels 15 with the retractable tensioning mechanisms 14 built into them. For example, the lever 50 may be pivotally mounted on the frame of the creel 15 itself, in which event the creel frame functions as the base member 56. In such instances the lever biasing mechanism, be it a suspended weight or a spring, may preferably be mounted on the opposite side of the creel frame from the yarn carrier tube 26. In such instances the disk 38 is still typically mounted on the same side of the creel frame as the yarn carrier tube 26 to facilitate coupling of the two together.

While the invention has been particularly shown and described with reference to preferred embodiments thereof, it will be understood by those skilled in the art that the foregoing and other changes in form and details may be made therein without departing from the spirit and scope of the invention.

I claim:

1. An arrangment for supplying an elongated member under tension comprising:

a rotatably mounted carrier having an elongated member wound thereon, the carrier being rotatable about an axis;

a member coupled to the carrier and rotatable about the axis and having a plurality of elements extending therefrom in a generally circular pattern having a center thereof approximately at the axis;

a pivotally mounted lever disposed at least partly within the generally circular pattern of the plurality of elements to engage the elements extending from the member and rotatable about a pivot axis which is generally parallel to and spaced-apart from the first-mentioned axis; and means for force-biasing the lever to rotate in a given direction about the pivot axis.

2. The invention set forth in claim 1, wherein the first-mentioned axis comprises the axis of elongation of the carrier, the member comprises a disk.

3. The invention set forth in claim 2, wherein the lever has an elongated tongue on one side of the pivot axis for engaging the elements extending from the member and a bracket on the other side of the pivot axis from the elongated tongue, and the means for force-biasing is coupled to the bracket.

4. The invention set forth in claim 3, wherein the means for force-biasing comprises a weight suspended from the bracket.

5. The invention set forth in claim 3, wherein the means for force-biasing comprises a coil spring having a first end coupled to the bracket and an opposite second end coupled to a reference.

6. The invention set forth in claim 2, wherein the lever has an elongated tongue on one side of the pivot axis for engaging the elements extending from the member and the means for force-biasing comprises a torsion spring extending along the pivot axis and having a first end coupled to the lever and an opposite second end coupled to a fixed reference.

7. The invention set forth in claim 2, wherein the plurality of elements comprises a plurality of pegs mounted in spaced-apart relation about the outer periphery of the disk, and further including a spindle extending along the axis of elongation of the carrier and rotatably mounting the carrier and the disk thereon, a base member mounted on the spindle and a shaft extending outwardly from the base member along the pivot axis, the shaft being generally parallel to and offset from the spindle and pivotally mounting the lever thereon.

8. An arrangement for supplying yarn under tension comprising the combination of:

a creel spindle;

a yarn carrier rotatably mounted on the spindle and having a length of yarn wound thereon;

a disk rotatably mounted on the spindle at one end of the yarn carrier, the disk being releasably coupled to the yarn carrier;

a plurality of spaced-apart elements mounted on the disk in a generally circular array about the spindle;

an elongated lever disposed at least partly within the generally circular array of the plurality of spaced-apart elements and having an outer end adapted to engage the plurality of spaced-apart elements;

means mounting the elongated lever for rotation about a pivot axis offset from and generally parallel to the spindle; and means for force-biasing the elongated lever in a given direction about the pivot axis.

9. The invention set forth in claim 8, further including a post mounted on and extending outwardly from the disk on a side of the disk opposite the plurality of spaced-apart elements, the post being adapted to be received within an aperture in the yarn carrier to releaseably couple the disk to the yarn carrier.

10. The invention set forth in claim 8, wherein the plurality of spaced-apart elements comprises a plurality of generally cylindrical pegs, and the elongated lever includes an elongated tongue on one side of the pivot axis having an outer end defining the outer end adapted to engage the plurality of spaced-apart elements.

11. A tensioning arrangement for use with a rotatable member for feeding a length of yarn into a loom comprising the combination of:

a disk mounted for rotation about a central axis and adapted to be coupled to a rotatable member for feeding a length of yarn into a loom;

a plurality of pegs mounted in a spaced-apart relation about the disk in a circular array having a center at the central axis;

an elongated lever disposed within the circular array and pivotally mounted about a pivot axis offset from the central axis; and means for force-biasing the lever in a given rotational direction about the pivot axis.

12. The invention set forth in claim 11, wherein the elongated lever has an elongated tongue having an outer end adapted to engage the plurality of pegs.

13. The invention set forth in claim 11, further including a base member disposed adjacent the disk and an offset shaft extending from the base member along the pivot axis and being generally parallel to the central axis and pivotally mounting the elongated lever thereon.

14. The invention set forth in claim 13, wherein the elongated lever has an elongated tongue adapted to engage the plurality of pegs and an opposite bracket coupled to the means for force-biasing.

15. The invention set forth in claim 14, wherein the means for force-biasing comprises a weight suspended from the bracket.

16. The invention set forth in claim 14, wherein the means for force-biasing comprises a tension spring having a first end coupled to the bracket and an opposite second end coupled to a reference.

17. The invention set forth in claim 11, further including a base member disposed adjacent the disk and having an aperture therein having an axis coinciding with the pivot axis and generally parallel with the central axis and a shaft coupled to the elongated lever and rotatably received within the aperture in the base member, and wherein the means for force-biasing includes a collar mounted on the shaft and a coiled torsion spring disposed about the shaft and having a first end coupled to the collar and an opposite second end coupled to the base member.

* * * * *